United States Patent [19]

Fiedziuszko et al.

[11] Patent Number: 4,692,723

[45] Date of Patent: Sep. 8, 1987

[54] NARROW BANDPASS DIELECTRIC RESONATOR FILTER WITH MODE SUPPRESSION PINS

[75] Inventors: Slawomir J. Fiedziuszko, Palo Alto; Craig A. Ziegler, Mountain View, both of Calif.

[73] Assignee: Ford Aerospace & Communications Corporation, Detroit, Mich.

[21] Appl. No.: 758,631

[22] PCT Filed: Jul. 8, 1985

[86] PCT No.: PCT/US85/01289

§ 371 Date: Jul. 8, 1985

§ 102(e) Date: Jul. 8, 1985

[87] PCT Pub. No.: WO87/00204

PCT Pub. Date: Jan. 15, 1987

[51] Int. Cl.[4] ..... H01P 1/20; H01P 1/162

[52] U.S. Cl. ..... 333/202; 333/212; 333/251

[58] Field of Search ..... 333/202, 208, 210, 211, 333/212, 219, 228, 251

[56] References Cited

U.S. PATENT DOCUMENTS

| | | | |
|---|---|---|---|
| 3,495,192 | 2/1970 | Gerlack | 333/212 |
| 4,028,652 | 6/1977 | Wakino et al. | 333/202 X |
| 4,124,830 | 11/1978 | Ren | 333/208 |
| 4,138,652 | 2/1979 | Nishikawa et al. | 333/251 X |
| 4,251,787 | 2/1981 | Young et al. | 333/209 |
| 4,321,568 | 3/1982 | Joyal et al. | 333/209 |
| 4,453,146 | 6/1984 | Fiedziuszko | 333/212 |
| 4,477,783 | 10/1984 | Atia | 333/202 |

FOREIGN PATENT DOCUMENTS

| | | | |
|---|---|---|---|
| 1961936 | 7/1970 | Fed. Rep. of Germany | 333/212 |
| 2726798 | 12/1977 | Fed. Rep. of Germany | 333/202 |
| 0155803 | 9/1982 | Japan | 333/228 |
| 0198003 | 11/1984 | Japan | 333/202 |

*Primary Examiner*—Eugene R. LaRoche
*Assistant Examiner*—Benny T. Lee
*Attorney, Agent, or Firm*—Edward J. Radlo; Keith L. Zerschling

[57] ABSTRACT

An extremely narrow-band bandpass electromagnetic filter comprises a waveguide (1) dimensioned below cutoff and having two or more active sections (30) each containing a dielectric resonator (6). The number of resonators (6) corresponds to the number of poles of filtering. The physical dimensions of the waveguide (1) can advantageously be further reduced by means of passive coupling means (40), where the waveguide (1) cross-section is smaller than in the active sections (30). Each passive coupling means (40) inductively couples adjacent active sections (30). Mode suppression rods (10) electrically connect opposing waveguide walls (2, 3) midway between each pair of adjacent dielectric resonators (6). Preferred embodiments are illustrated, in which the resonators (6) are tranversely oriented within the waveguide (1). Electromagnetic energy travels within the waveguide (1) in a single $TE_{10}$ evanescent mode ($TE_{01\delta}$ within the resonators (6)). Dielectric tuning means (9) are generally aligned along the principal axis of each resonator (6). A number of such filters, exhibiting extremely narrow bandwidth, low insertion loss, and high Q, have been successfully built.

5 Claims, 2 Drawing Figures

NARROW BANDPASS DIELECTRIC RESONATOR FILTER WITH MODE SUPPRESSION PINS

DESCRIPTION

1. Technical Field

This invention pertains to the field of filtering electromagnetic energy so that only a narrow band of frequencies is passed.

2. Background Art

U.S. Pat. No. 4,138,652 discloses a waveguide employing dielectric resonators, operating in an evanescent mode. The present invention differs from the device disclosed in the reference patent is that: (1) mode suppression rods 10 are located, not along the principal axes of the dielectric resonators 6, but midway between resonators 6; (2) the mode suppression rods 10 electrically connect opposing waveguide walls 2, 3, while the mode suppression rods in the patent are connected to just the lower waveguide wall; and (3) optional passive coupling means 40 are used, in which the waveguide 1 cross-section is smaller than in the sections 30 where the resonators 6 are situated. Advantages of the present invention include: (1) a simpler mechanical configuration, since no drilling of holes through the resonators 6 or mounting rings 7 is required; (2) suppression of the propagating spurious modes in the waveguide 1, not in the resonators 6; thus, the resonators 6 are less affected by the suppression rods 10; (3) higher Q factor of the resonators 6 (a severe degradation of Q factor would occur if a suppression rod were placed in the center of a dielectric resonator as in the reference patent and shorted to the top and bottom waveguide walls); (4) ability to use standardized waveguide housing; (5) more precise adjustment of coupling between active sections 30 via the passive coupling means 40; and (6) lower cost.

U.S. Pat. No. 4,124,830 discloses a waveguide filter operating in a propagating mode, not in an evanescent mode as in the present invention. The filter is a bandstop filter, not a bandpass filter as in the present invention.

U.S. Pat. No. 3,495,192 discloses a waveguide operating in a propagating mode, not in an evanescent mode as in the present invention. No suggestion of the dielectric resonators of the present invention is made.

Secondary references are: U.S. Pat. Nos. 4,251,787; 4,321,568; and 4,453,146.

DISCLOSURE OF INVENTION

The present invention is a very narrow-band bandpass filter comprising an electrically conductive hollow waveguide (1) having four elongated walls (2, 3, 4, 5). The waveguide (1) is "dimensioned below cutoff", where the "cutoff" frequency is the lowest frequency at which propagation can occur in the waveguide (1) in the absence of any internal structures such as the resonators (6). Thus, "dimensioned below cutoff" means that in the absence of dielectric resonators (6), the waveguide (1) is sufficiently small that propagation cannot take place at the chosen frequency. The presence of two or more dielectric resonators (6) within the waveguide (1) insures that propagation in an evanescent mode does occur within the waveguide (1).

Elongated electrically conductive mode suppression rods (10) connect opposing waveguide walls (2, 3) midway between each pair of adjacent dielectric resonators (6).

Preferred embodiments of the invention are illustrated infra, in which the dielectric resonators (6) are transversely oriented within the waveguide (1). The principal axis of each resonator (6) is substantially parallel to each mode suppression rod (10). In order to further shrink the physical size of the filter, which is very important for spacecraft and other applications, each pair of adjacent active sections (30) of the waveguide (1) (i.e., sections in which a resonator (6) is present) is separated by a passive coupling means (40) in which the waveguide (1) cross-section is smaller than in an active section (30). For example, inductive partitions (12) are used for the passive coupling means (40), providing some attenuation while enabling magnetic coupling between adjacent resonators (6).

The resonators (6) can be designed to provide thermal compensation. A dielectric perturbation means (9) can be generally aligned along the principal axis of each resonator (6) to effectuate fine increases in the resonant frequency.

BRIEF DESCRIPTION OF THE DRAWINGS

These and other more detailed and specific objects and features of the present invention are more fully disclosed in the following specification, reference being had to the accompanying drawings, in which.

BEST MODE FOR CARRYING OUT THE INVENTION

Figure 1:
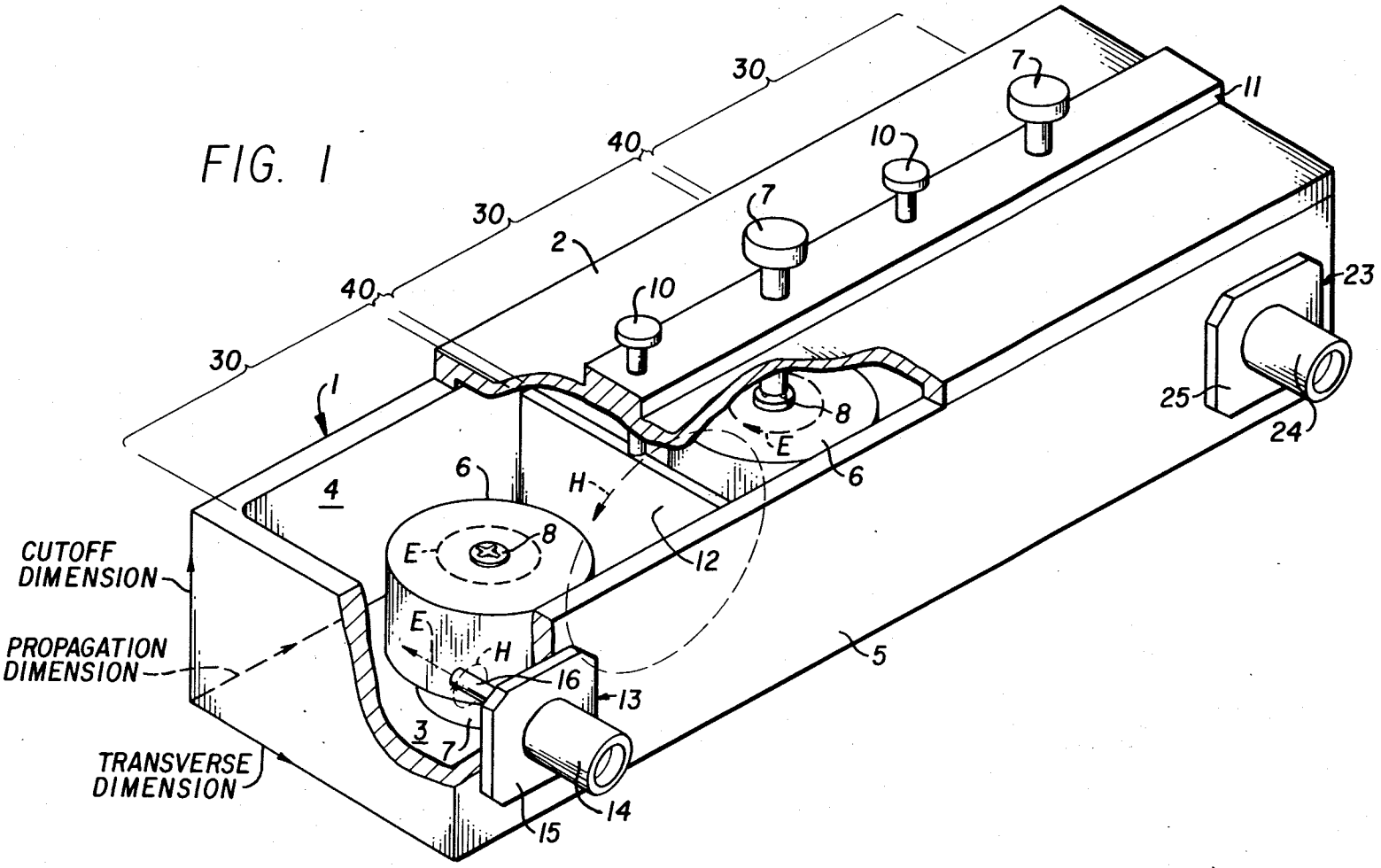
FIG. 1 is a partially broken-away isometric view of a three-pole embodiment of the present invention.

Extremely narrow bandpass filters find applications in multiple frequency generation systems that require rejection of very closely spaced signals. In the past, use of such filters was not considered because available implementations were either too lossy (low-Q elements) or too heavy and bulky, especially at lower frequencies (e.g., high-Q waveguide cavities). The present invention successfully addresses this problem, in many cases leading to great simplification of the frequency generation system.

Typically, very narrow-band bandpass filters present problems of excessive loss (directly related to filter bandwidth) and troublesome temperature stability, because metal and GFRP (graphite fiber reinforced plastic) cavities usually do not track well over temperature. In the present invention, on the other hand, the use of reduced size waveguide 1, dielectric resonators 6, passive coupling means 40 between resonators 6, and spurious mode suppression rods 10 results in filters that exhibit reasonable insertion loss, combined with reduced size and weight, low cost, and outstanding temperature stability.

In the preferred embodiments illustrated herein, single-mode $TE_{10}$ evanescent energy propagates within the waveguide 1 ($TE_{01\delta}$ within resonators 6). Since it is assumed that the filter is to be used in the vicinity of a single frequency of operation, sophisticated elliptic function responses are not necessary. Basic electrical design of the embodiments described herein follows standard steps for Chebyshev responses; the required coupling coefficients are calculated. Utilizing derived formulas for coupling between dielectric resonators in a rectangular waveguide below cutoff, the spacings between resonators is determined. Values of the coupling coefficients required by electrical design are easily measured and eventually adjusted using the phase method.

A typical filter configuration is presented in FIG. 1. Waveguide 1 has a rectangular cross-section. Walls 2 and 3 are relativey wide; walls 4 and 5 are relatively narrow. Low-dielectric-constant, low-los ring 7s are used to mechanically support resonators 6 in spaced-apart relationship with respect to one of the wide waveguide walls 3. Electrical (SMA) connectors 13, 23 are used for input and output coupling, respectively, to the outside environment. Input connector 13 comprises a mounting flange 15 attached to one of the narrow waveguide walls 5, a ring 14 providing a means for grounding an outer shield of an input cable (not illustrated) to the waveguide 1, and an elongated electrically conductive probe 16 for introducing the electromagnetic energy in the center conductor of the input cable into the waveguide 1. The E-vector of the desired mode is parallel to probe 16, as illustrated in FIG. 1. The H-vector forms a series of concentric rings orthogonal to the E-vector within the waveguide 1 cavity.

A set of three orthogonal axes is defined in FIG. 1: propagation, transverse, and cutoff. The propagation dimension is parallel to the long axis of the waveguide 1 and coincides with the direction in which electromagnetic energy propagates within waveguide 1. The transverse dimension is orthogonal to the propagation dimension and parallel to the free-space cavity E-vector of the desired mode. Along the transverse dimension is measured the widths of the two wide waveguide walls 2, 3. The cutoff dimension is orthogonal to the propagation dimension and to the transverse dimension. Along the cutoff dimension is measured the widths of the two narrow waveguide walls 4, 5, which widths, being orthogonal to the free-space cavity E-vector, determine the cutoff frequency of waveguide 1.

Resonators 6 are oriented transversely within the waveguide 1. By this is meant that the principal axis of each resonator 6 is parallel to the cutoff dimension. FIG. 1 illustrates an embodiment in which there are three resonators 6, and thus the filter is a three-pole filter. Resonators 6 are illustrated as being cylindrical in shape. However, resonators 6 can have other shapes, such as rectangular prisms, as long as their principal axes are parallel to the cutoff dimension.

Within each resonator 6, the E-vector of the desired mode is in the form of concentric circles lying in planes orthogonal to the principal axis of the resonator 6. Coupling between adjacent resonators 6 is magnetic, as illustrated by the circular dashed H-vector line in FIG. 1. The resonators 6 are preferably substantially identical and centered, with respect to the propagation and transverse dimensions, within their corresponding active sections 30.

In an extremely narrow-band filter, resonators 6 are coupled very weakly; therefore, the spacings between resonators 6 would be quite large if an open waveguide 1 below cutoff were used. To reduce the size of the filter and provide control of coupling by means other than by spacing between resonators 6 (which greatly facilitates tuning), passive coupling means 40 are optionally introduced into the waveguide 1 below cutoff, midway between each pair of adjacent resonators 6. Each mode suppression rod 10 is centered, with respect to the propagation and transverse dimensions, within the corresponding passive coupling means 40. Passive coupling means 40 can be any means which shrinks the waveguide 1 cross-section compared with the active regions 30. Passive coupling means 40 attenuates some of the energy while allowing the desired degree of inductive coupling.

In the case where the passive coupling means 40 is formed by means of a partition 12, as illustrated in FIG. 1, the partition 12 forms a variably-placed variably-sized opening in the waveguide 1 cross-section, since such planar partitions 12 can easily be made to have a controllably variable partition height, allowing standardization of the waveguide 1. Use of such partitions 12 can reduce the filter size by approximately 30%. In FIG. 1, the opening in the waveguide 1 cross-section that is formed by the partition 12 is illustrated as being in the vicinity of wide waveguide wall 2. Partition 12 is electrically conductive so that, in combination with mode suppresion rod 10, an electrically conductive path is formed between the wide waveguide walls 2, 3. The E-vectors of spurious modes are parallel to the mode suppression rods 10 and are electrically shorted thereby to the waveguide walls 2, 3, rendering said spurious modes impotent.

Flange 11 provides additional mechanical support for mode suppression rods 10 and dielectric tuning means 9. Each dielectric tuning means 9 is generally aligned along the principal axis of its corresponding dielectric resonator 6, and engages a dielectric tuning screw 8 therewithin. By rotating the dielectric tuning means 9, the magnetic field associated with the corresponding resonator 6 is perturbed, resulting in a corresponding small increase in the resonant frequency.

Energy exits the waveguide 1 by means of output connector 23, which is illustrated as being an SMA connector identical to input connector 13. Output connector 23 has a mounting flange 25 and an outer grounding ring 24.

Two types of high performance ceramics are suitable for resonators 6: zirconium stanate ($ZrSnTiO_4$) and an advanced perovskite added material ($BaniTaO_3$-$BaZrZnTaO_3$). Perovskite added material, due to its Q and dielectric constant, is more suited for higher frequency applications, e.g., 4 GHz and above. A disadvantage of this material is its density; resonators 6 fabricated of perovskite added material are 50% heavier than those using zirconium stanate. Zirconium stanate gives acceptable performance up to 6 GHz and very good results at frequencies below 2 GHz.

For the supportive rings 7, crosslinked polystyrene (Rexolite), boron nitride, and silicon dioxide foam (space shuttle thermal tile) give satisfactory performance. Polystyrene foam, while excellent electrically, is unsuitable because it has poor mechanical properties and poor outgassing properties due to its closed cell structure, which makes it unacceptable for uses in vacuum such as in space. Alumina and forsterite have relatively high, changing dielectric constants, resulting in significant degradation of the stable properties of the ceramic dielectric resonators 6. Silicon dioxide ($SiO_2$) exhibits excellent electrical properties, especially at higher frequencies, such as 12 GHz. This material is easy to machine but is fragile; thus, extra care has to be used during handling and assembly. Also, due to its insulation properties, only low power applications, such as input multiplexer satellite filters, are possible in vacuum.

Experimental two, three, and four-pole filters were built and extensively tested for space applications. The isolated dielectric resonators 6 for the cognizant frequencies (approximately 3 GHz) exhibited excellent unloaded Q factors. Q's on the order of 15,000 were obtained with $ZrSnTiO_4$ ceramics, e.g., Murata Manufacturing Company's Resomics 04C. Such excellent Q is degraded by mounting arrangements as well as by the presence of the metal waveguide walls 2–5. With the reduced size waveguides 1 described herein, the Q factor was typically degraded to a value of 8000 to 9000, which more than adequate to meet the insertion loss requirements.

One of the important factors in single-mode filters is the presence of troublesome spurious modes, frequently appearing very close to the passband of the filter. The use of waveguide 1 below cutoff, passive coupling means 40, and mode-suppression rods 10 resulted in very good out-of-band characteristics.

The dielectric resonators 6, mounted in a waveguide using commercially available mounting assemblies, exhibited excellent mechanical and electrical characteristics. The filters were subjected to high levels of sinusoidal and random vibrations, and no frequency shifts were detected.

Figure 2:
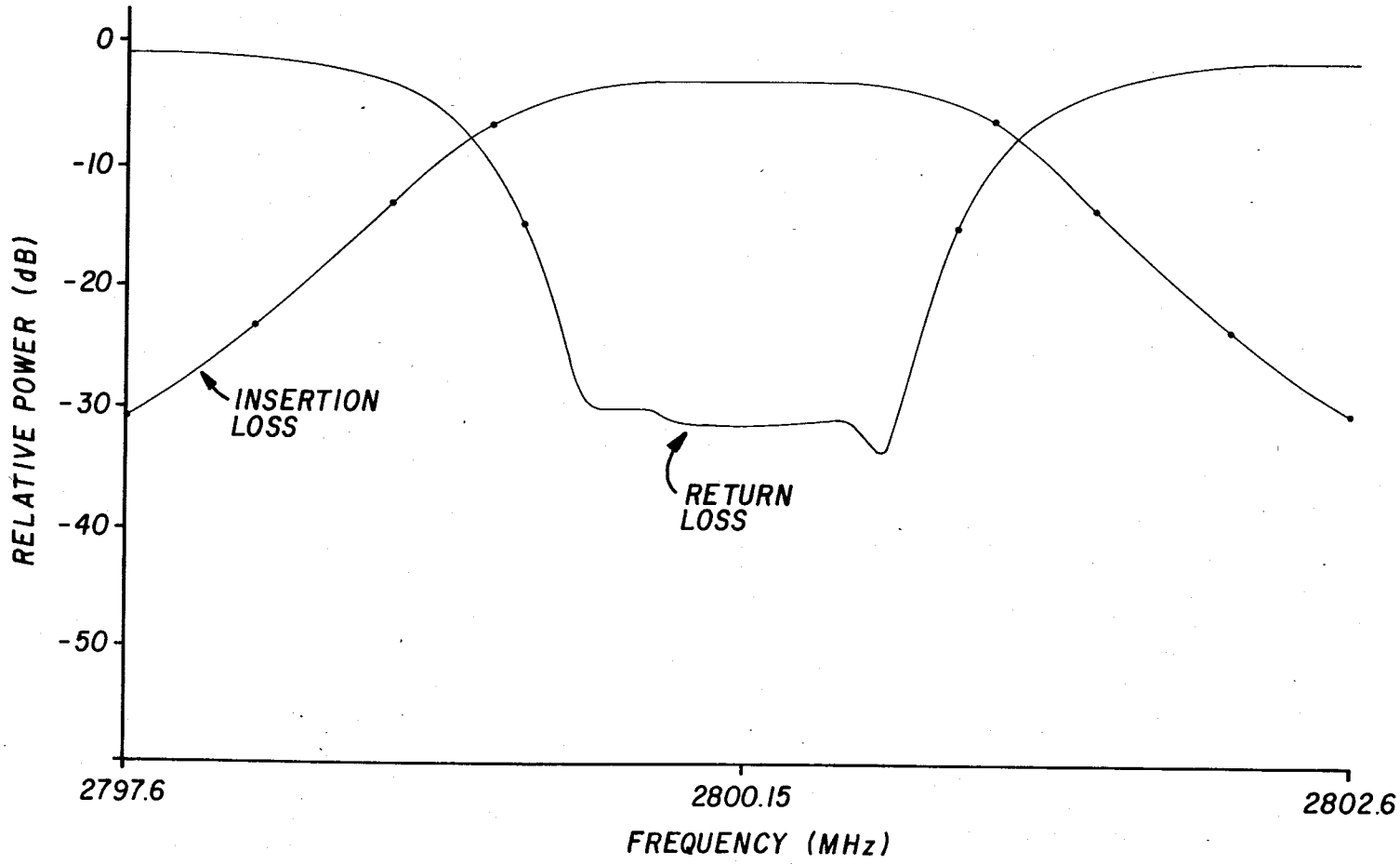
FIG. 2 is a graph of insertion loss and return loss for a built four-pole embodiment of the present invention.

Typical response of one of the built four-pole filters is shown in FIG. 2. Excellent correlation with theory, and an equivalent Q of approximately 8000, were obtained, in spite of the fact that an unplated aluminum housing was used for waveguide 1. The insertion loss (attenuation) curve shows that the 3 dB insertion loss bandwidth is approximately 2.04 MHz. The return loss curve shows that the 15 dB equal reflection return loss bandwidth is 1.76 MHz. The passband is extremely narrow, considering that the filter operates in the S-band.

One of the advantages of the dielectric resonators 6 described herein is their excellent temperature performance, which is adjustable by resonator 6 material composition. Resonators 6 with different temperature frequency coefficients (e.g., −2, 0, +2, +4) are commercially available, allowing for almost perfect compensation of waveguide 1 temperature effects. For example, aluminum waveguide 1 expands at 23 ppm per degree C. This has an effect on the resonator 6 as if it were −4 ppm/°C. in terms of frequency, so a thermal expansion coefficient of +4 is selected for the dielectric resonator 6 to compensate for this frequency shift. In one of the four-pole filters that was built at S-band, the maximum frequency shift was on the order of 60 KHz over a −10° C. to +61° C. temperature range, which indicates almost perfect temperature compensation.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. A narrow bandpass filter for filtering electromagnetic energy comprising dielectric resonators positioned within an elongated waveguide having a rectangular cross-section, four elongated electrically conductive walls, and wherein the dimensions of the waveguide are sufficiently small such that the electromagnetic energy would be cut off and would not propagate through the filter in the absence of the dielectric resonators; wherein:

said waveguide comprises at least two active sections each containing a dielectric resonator;

each two adjacent active sections are coupled by means comprising an electrically conductive partition which continuously abuts three of the waveguide walls and constricts the waveguide cross-section thereby forming a coupling opening for passing the electromagnetic energy between adjacent active sections;

one of a set of elongated electrically conductive mode suppression rods bisects each coupling opening, and physically and electrically connects the remaining one of the waveguide walls with the partition corresponding to said coupling opening thereby forming an electrical short circuit between a first pair of opposing waveguide walls midway between a second pair of opposing waveguide walls; and the electromagnetic energy within the waveguide propagates in a single $TE_{10}$ evanescent mode.

2. The filter of claim 1 wherein:

the rectangular waveguide cross-section has a relatively small cutoff dimension measured between the first pair of waveguide walls and a relatively large transverse dimension, orthogonal to the cutoff dimension, measured between the second pair of waveguide walls;

the principal axis of each dielectric resonator is substantially parallel to each mode suppression rod; and the dielectric resonators are transversely oriented within the waveguide, i.e., the principal axis of each resonator is parallel to the cutoff dimension.

3. The filter of claim 1 wherein the dielectric resonators are selected to have a thermal expansion coefficient that compensates for frequency drift associated with expansion of the waveguide walls caused by increasing temperature.

4. The filter of claim 1 wherein each dielectric resonator has the shape of a cylinder having a principal axis, said filter further comprising, associated with each dielectric resonator, means, protruding through a waveguide wall and generally aligned along the principal axis of said corresponding resonator, for selectively perturbing the magnetic field associated with said corresponding resonator, thereby serving to increase the resonant frequency of the filter.

5. The filter of claim 1 wherein:

the dimension of elongation of the waveguide is the propagation dimension, i.e., the dimension along which the electromagnetic energy propagates;

the waveguide cross-section, which is orthogonal to the propagation dimension, comprises a cutoff dimension measured between the first pair of waveguide walls and a transverse dimension which is orthogonal to and longer than the cutoff dimension and is measured between the second pair of waveguide walls; and within each active section, the projection of the corresponding dielectric resonator onto two rectangular portions, associated with said active section, of the first pair of waveguide walls is centered with respect to said two rectangular portions of the first pair of waveguide walls.

* * * * *